United States Patent [19]

Tolun et al.

[11] 4,444,633

[45] Apr. 24, 1984

[54] PRODUCTION OF SODIUM HYDROXIDE AND BORIC ACID BY THE ELECTROLYSIS OF SODIUM BORATE SOLUTIONS

[75] Inventors: Raşit Tolun, Erenköy; Bedri D. Emir, Etiler; Ismail E. Kalafatoğlu; Sidika Kocakuşak, both of Erenköy; Nuran Yalaz, Kiziltoprak, all of Turkey

[73] Assignee: Turkiye Bilimsel ve Teknik Arastirma Kurumu, Turkey

[21] Appl. No.: 451,241

[22] Filed: Dec. 20, 1982

[30] Foreign Application Priority Data

Dec. 18, 1981 [TR] Turkey ..... 118584

[51] Int. Cl.[3] ..... C25B 1/16; C25B 1/22

[52] U.S. Cl. ..... 204/98; 204/103

[58] Field of Search ..... 204/98–99, 204/103

[56] References Cited

U.S. PATENT DOCUMENTS 2,014,148 9/1935 Sievert ..... 204/86

3,038,842 6/1962 Mollard ..... 204/85

FOREIGN PATENT DOCUMENTS 411258 6/1910 France ..... 204/85

*Primary Examiner*—R. L. Andrews

*Attorney, Agent, or Firm*—Price, Heneveld, Haizenga and Cooper

[57] ABSTRACT

An industrial process is one for the economic production of boric acid and sodium hydroxide or a sodium salt, from sodium borates. Boric acid solution, sodium hydroxide solution, oxygen and hydrogen gases are produced by the electrolysis of sodium borate solutions. Mercury cathode and cation exchange membrane methods have been applied to the electrolysis of sodium borate solutions and, for the economical production of pure boric acid and sodium hydroxide, it was confirmed that the working temperature must be between 60°–100° C., working voltage must be 3.5–5.0 volts, $Na_2O/B_2O_3$ mole ratio at the end of the electrolysis must be 0.15–0.05 and the crystallization temperature must be between 5°–40° C.

17 Claims, 3 Drawing Figures

PRODUCTION OF SODIUM HYDROXIDE AND BORIC ACID BY THE ELECTROLYSIS OF SODIUM BORATE SOLUTIONS

This invention relates to the production of sodium hydroxide and boric acid by the electrolysis of sodium borate solutions.

Sodium hydroxide is generally produced together with chlorine gas by electrolysis of sodium chloride.

$$2NaCl+2H_2O \rightarrow 2NaOH+Cl_2(g)+H_2(g)$$

In Turkey, as in other developing countries, sodium hydroxide production can not be increased to meet the demand, because a market can not be found for all the chlorine gas which would be produced. Therefore, it is thought that sodium hydroxide could be produced from other sodium salts, i.e. sodium borates.

$$Na_2B_4O_7.10H_2O \rightarrow 4H_3BO_3+2NaOH+\tfrac{1}{2}O_2(g)+H_2(g)+2H_2O$$

A special condition for Turkey is that she has large sodium borate mineral (tincal, $Na_2B_4O_7.10H_2O$) deposits. Moreover, another advantage of the invented process from an economical point of view is that, approximately 3.5 tons of boric acid is produced, instead of 1 ton of chlorine gas produced in the chlor-alkali processes.

Studies having the objectives of production of boric acid from sodium borates by electrolysis have been done previously. But these studies were insufficient in both economy and purity of the product, so that they could not be applied. For example, in a study of U.S. Borax Corp., only the production of sodium pentaborate solution could be achieved, instead of boric acid, in the experiments of electrolysis using cation exchange membrane (British Pat. No. 937,187, 1963). In order to obtain boric acid, the obtained sodium pentaborate solution has to be acidified. However, in our invention pure boric acid is produced in a single operation instead of two operations, without need of any other acid addition. In a second study of U.S. Borax Corp., both anionic and cationic membranes were used in a three compartment cell (British Pat. No. 1,022,395, 1966). In this study, to increase the efficiency of the process, the central compartment was filled with either a mixed cationic/anionic or an anionic or cationic ion exchange resin. However, the efficiency could not be sufficiently increased. The wide anode-cathode distance in this system will cause a large voltage drop and high energy consumption. Also another economic disadvantage is the usage of two different kinds of membranes. In this and in the third and last study of U.S. Borax Corp., (British Pat. No. 1,030,969, 1966) on electrolysis of sodium borate solutions, sodium sulfate or sulfuric acid were added to decrease energy consumption, by increasing the conductivity of the solutions. However, these will increase the impurity of the boric acid solution. This will limit boric acid crystallization conditions. In this case, boric acid crystals must be washed or recrystallized. Evaporation of washing filtrates will increase the cost of production.

The basis of this application for patent, is that in our studies we have by our invention accomplished the process in its simplest form. In other words, the production of pure sodium hydroxide and pure boric acid in most economic conditions is achieved simply by electrolysis of sodium borate solutions without using any other additives, by applying either mercury cathode or single, cation exchange membrane method as in the production of chlorine gas and sodium hydroxide by sodium chloride electrolysis.

In the proposed invention, studies were conducted on two different electrolysis methods: (1) Mercury cathode method, (2) Cation exchange membrane method. Although it is known that these two methods are industrially applied widely in chlor-alkali plants, this study has resulted in an invention, since our experiments for the economic production of boric acid, by applying specific conditions to the electrolysis of sodium borate solutions and using controlled crystallization method, were successful.

The difference in the process from chlor-alkali processes results from the reactions in the anodic compartment. Boric acid, resulting from the dissolution, hydrolysis and anodic reactions $$Na_2B_4O_7+5H_2O \rightarrow 2Na^+ +2H_2BO_3^- +2H_3BO_3$$

$$2H_2BO_3^- +H_2O \rightarrow \tfrac{1}{2}O_2(g)+2H_3BO_3+2e^-$$

makes the medium in the anodic compartment an aqueous mixture of boric acid and borax. In the cathodic compartment, sodium hydroxide is formed according to the following reaction:

$$2Na^+ +2H_2O+2e^- \rightarrow H_2(g)+2NaOH$$

Crystallization of boric acid, in the electrolysis cell is prevented by controlling the $Na_2O/B_2O_3$ mole ratio. The production of pure boric acid was achieved by controlled crystallization of anolyte.

Critical parameters, which determine the energy consumption and product purity are concentration of sodium ions, $Na_2O/B_2O_3$ mole ratio and working temperature. It is appropriate that the working temperature is between 60° to 100° C., preferably 80° C., and the anolyte is saturated at the end of the electrolysis. In order to decrease energy consumption, there must be sufficient quantity of sodium ions to conduct the current at the end of the electrolysis. To obtain this, the $Na_2O/B_2O_3$ mole ratio in the electrolyte must be between 0.15–0.05, preferably 0.1. Thus, the anolyte will contain a sufficient quantity of sodium ions for adequate conductivity and an excessive amount of $B_2O_3$ at the end of the electrolysis. When the anolyte is cooled from 80° C. to 5°–40° C., preferably to 30° C., pure boric acid will be obtained. The mother liquor from boric acid crystallization is heated, recirculated and used for dissolving borax mineral. Electrolysis of the obtained borax solution completes the cycle.

In this way energy consumption, which is related to the changes in crystallization yield and to the conductivity of the electrolyte, which again depend on the $Na_2O/B_2O_3$ mole ratio at the end of electrolysis, has been optimized.

While pure boric acid is produced at the end of the process, pure 50% sodium hydroxide is produced simultaneously in the mercury cathode method and 20–30% pure sodium hydroxide in the membrane method. The concentration of the sodium hydroxide produced in the membrane electrolysis method depends on the properties of the membrane used and on the process conditions. in the mercury cathode process, the water formed according to the process overall reaction equation, must be evaporated. However, in the membrane electrolysis process, water must be added to the system, since the amount of the evolved water according to this reaction, is less than the amount of the water transported to the cathodic compartment by sodium ions through the membrane.

Our invention is related to the formation of boric acid in the anode compartment. Although sodium hydroxide solution is formed as a product in the cathode compartment during electrolysis, it is obvious that with the help of the sodium hydroxide which forms during the electrolysis, another sodium salt may be obtained by introducing a suitable salt or acid solution to the cathode compartment, instead of water. For example, sodium carbonate can be produced in the cathode compartment by the addition of bicarbonate solution or phosphate salts, by the addition of phosphoric acid solution.

The electrodes and the membranes which are going to be used in both of the electrolysis methods are produced commercially and there will be no problem in the application of the invention to the industry.

Figure 1:
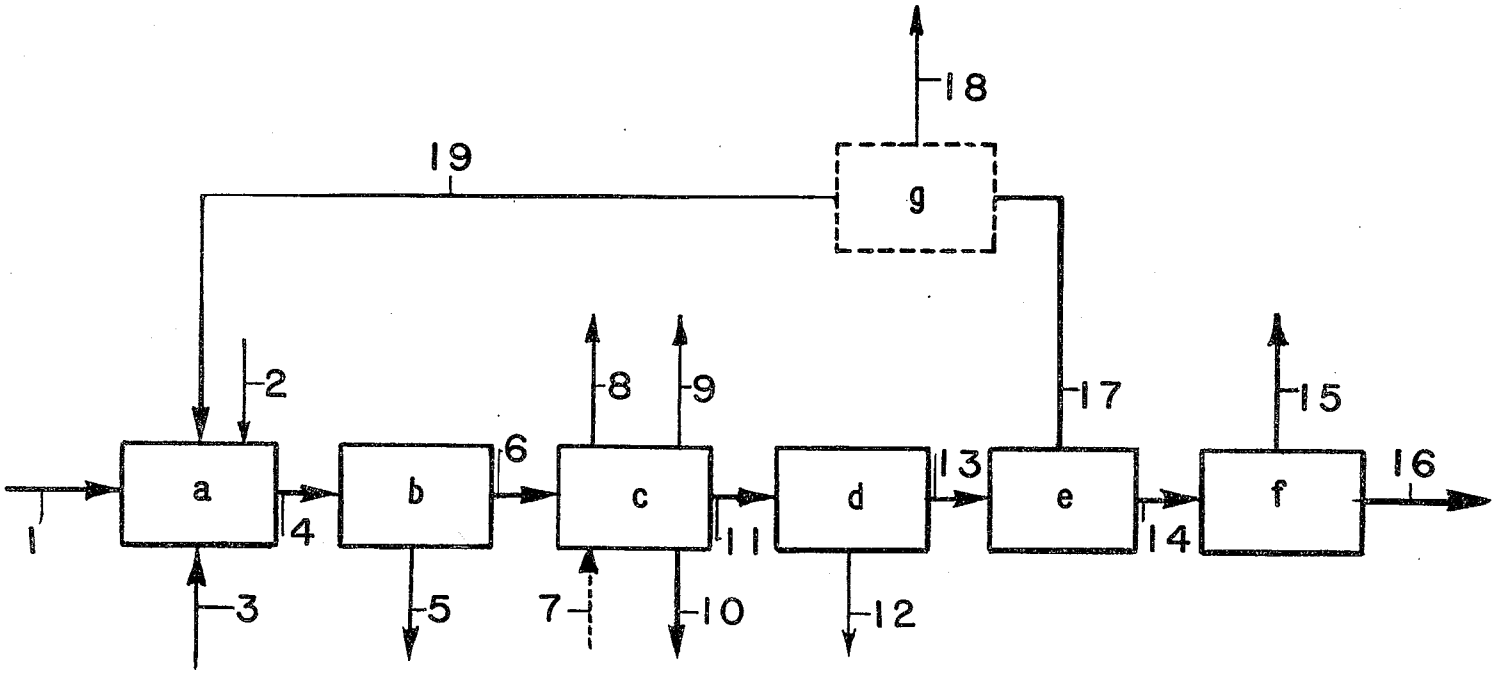
FIG. 1 is a flow diagram of the process

The flow of the process is shown in FIG. 1, (flow diagram of the process). Sodium borate (1) is dissolved (a) in water (2) and in recycled mother liquor (19) by heating (3). The mixture (4) is then filtered (b). The filtrate (6) which is separated from the insolubles (5) is electrolyzed (c). Depending on the method applied, water (7) is added during the electrolysis. Sodium hydroxide solution (10) and boric acid solution (11) are obtained at the end of the electrolysis, as well as hydrogen (8) and oxygen (9) gases. Boric acid is crystallized (d) by cooling (12) the boric acid solution. The slurry (13) is filtered (e). Wet boric acid crystals (14) are dried (f) to obtain pure boric acid (16). Boric acid filtrate (17) may be evaporated (g) according to the applied method, to remove the excess water (18) of the system. The mother liquor (19) is then recycled to dissolve (a) sodium borate.

Two examples for the two electrolysis methods are given below:

EXAMPLE 1

Figure 2:
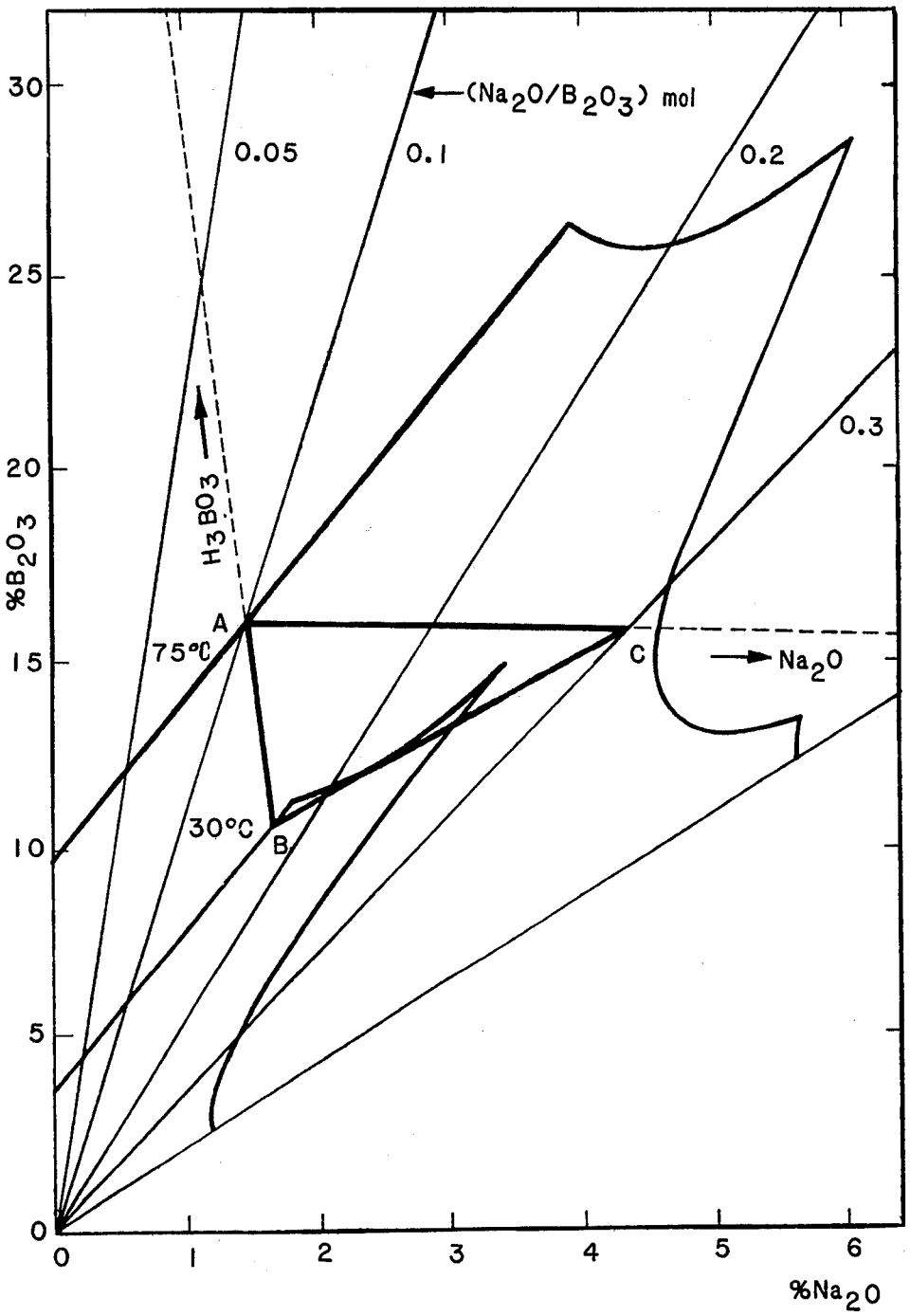
FIGS. 2–3 show Borax electrolysis processes.

Working region (Triangle ABC) of borax electrolysis process with mercury cathode method is shown in FIG. 2. An electrolysis cell which contains a mercury cathode with continuously renewed surface and a platinum oxide anode coated on titanium substrate, with a 5 mm anodecathode gap, was used in the experiment. 100 g of a solution which contains 4.4% $Na_2O$ and 15.7% $B_2O_3$ by weight (point C) was electrolyzed at 80° C. and at a current density of 0.15 amp/cm$^2$, until $Na_2O/B_2O_3$ mole ratio dropped to 0.1 (point A). The working voltage was 4.2–5.8 volts. The current efficiency was found to be 78.4%. Under these conditions, the required electrical energy, was 4400 kWh per ton of 100% NaOH. It is found by analysis that during electrolysis, sodium ions corresponding to 3.9 g of NaOH passed to the decomposer section via the mercury surface. Boric acid was crystallized by cooling the electrolyte to 30° C. (point B), filtered, and after drying 12 g of boric acid was obtained. The boric acid filtrate was heated to 80° C., 21 g of tincal (which contained 10% insolubles) was dissolved, filtered and thus the composition of the solution reached to point C.

EXAMPLE 2

Figure 3:
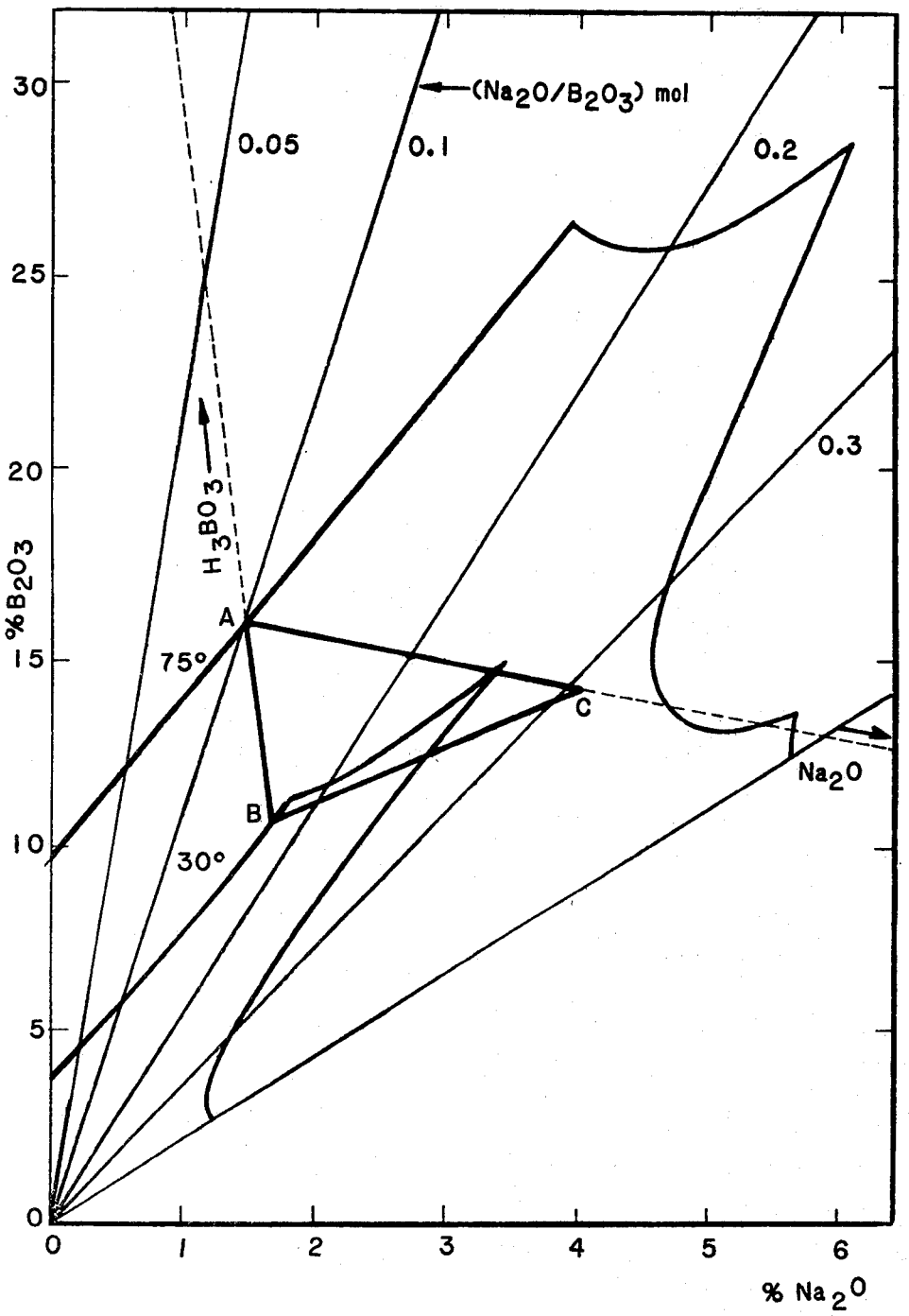

Working region (triangle ABC) of borax electrolysis process with cation exchange membrane method is shown in FIG. 3, using solubility isotherms. A two compartment electrolysis cell separated by a cation exchange membrane was used. The anode was platinum oxide coated on titanium substrate, the cathode was stainless steel (304). The gap between anode and cathode was 3 mm, and the working temperature was 80° C. In this experiment Nafion 324 membrane produced by Du Pont Co. was used. 2.0 kg of anolyte which contains 4.0% $Na_2O$, 14.1% $B_2O_3$ by weight and 1.5 kg of catholyte containing 15.7% NaOH by weight were used. These solutions were electrolyzed until the $Na_2O/B_2O_3$ mole ratio in the anode compartment had reached 0.1 (point A). The working voltage was 4.0–5.5 volts, the current density was 0.13 amp/cm$^2$. The current efficiency was calculated to be 88.3% and the electrical energy requirement based on experimental data was 3460 kWh for the production of 1 ton of 100% NaOH. It is found by analysis that during electrolysis, sodium ions corresponding to 69.3 g of NaOH passed to the cathode compartment through the membrane. By cooling the anolyte to 30° C., boric acid was crystallized (point B), filtered and dried to obtain 214.0 g of boric acid. The boric acid filtrate was heated to 80° C. and 372.0 g tincal was dissolved and filtered. Thus, the composition of solution reached again to the point C.

What we claim is:

1. An economical process for the production of sodium hydroxide and boric acid from borax, including the steps:

(a) mixing borax with water to form an aqueous solution of borax;

(b) introducing said aqueous solution of borax into an electrolysis cell having cathode and anode compartments;

(c) applying a current across said cell to effect electrolysis;

(d) maintaining the $Na_2O/B_2O_3$ ratio between about 0.15 and about 0.05 at the anode compartment outlet during electrolysis;

(e) collecting sodium hydroxide solution from said cathode compartment;

(f) collecting boric acid solution which contains a small amount of borax from said anode compartment.

2. The process as recited in claim 1 which includes the further step of maintaining said aqueous borax solution at a temperature between about 60° C. and 100° C. during electrolysis.

3. The process as recited in claim 2 wherein said ratio is maintained at about 0.1.

4. The process as recited in claim 3 wherein said temperature is maintained at about 80° C.

5. The process as recited in claim 4 which includes the further step of filtering said solution after said borax is mixed with water and after said borax solution is heated to about 80° C., and then introducing said filtrate to said cell for electrolysis.

6. The process as recited in claim 5 wherein crystalline boric acid is obtained by cooling said boric acid solution collected from said anode compartment and filtering said cooled boric acid solution to collect boric acid crystals.

7. The process as recited in claim 6 wherein the filtrate from said filtered cooled boric acid solution is evaporated to remove excess water and recycled to mix with said borax.

8. The process recited in claim 1 in which the electrolysis cell includes the use of a cathode of the flowing mercury type.

9. The process recited in claim 1 in which the electrolysis cell is of the cation exchange membrane type.

10. The process for the production of a sodium salt and boric acid from borax, including the steps:

(a) mixing borax with water to form an aqueous solution of borax;

(b) introducing said aqueous solution of borax into an electrolysis cell having cathode and anode compartments;

(c) applying a current across said cell to effect electrolysis;

(d) maintaining the $Na_2O/B_2O_3$ ratio between about 0.15 and about 0.05 at the anode compartment outlet during electrolysis;

(e) introducing one of a suitable salt and an acid solution to said cathode compartment;

(f) collecting a sodium salt solution from said cathode compartment;

(g) collecting boric acid solution which contains a small amount of borax from said anode compartment.

11. The process as recited in claim 10 which includes the further step of maintaining said aqueous borax solution at a temperature between about 60° C. and 100° C. during electrolysis.

12. The process as recited in claim 11 wherein said ratio is maintained at about 0.1.

13. The process as recited in claim 12 wherein said temperature is maintained at about 80° C.

14. The process as recited in claim 13 which includes the further step of filtering said aqueous borax solution after said borax is mixed with water and after said borax solution is heated to about 80° C., and then introducing said filtrate to said cell.

15. The process as recited in claim 14 wherein crystalline boric acid is obtained by cooling said boric acid solution collected from said anode compartment and filtering said cooled boric acid solution to collect boric acid crystals.

16. The process as recited in claim 15 wherein the filtrate from said filtered cooled boric acid solution is evaporated to remove excess water and recycled to dissolve said borax.

17. A process for the production of sodium hydroxide and boric acid from borax, including the steps:

(a) mixing borax with water to form an aqueous solution of borax;

(b) introducing said aqueous solution of borax into an electrolysis cell having cathode and anode compartments;

(c) applying a current across said cell to effect electrolysis;

(d) maintaining the $Na_2O/B_2O_3$ ratio between about 0.15 and about 0.05 at the anode compartment outlet during electrolysis;

(e) collecting sodium hydroxide solution from said cathode compartment;

(f) collecting a solution from said anode compartment which contains essentially boric acid.

* * * * *